United States Patent [19]

Bohl et al.

[11] Patent Number: 4,715,337

[45] Date of Patent: Dec. 29, 1987

[54] ENGINE IGNITION SYSTEM WITH AN INSULATED AND EXTENDABLE EXTENDER

[75] Inventors: Phillip B. Bohl, Chillicothe; Rodney J. Gillette, Peoria; James C. Smith, Washington, all of Ill.

[73] Assignee: Caterpillar Inc., Peoria, Ill.

[21] Appl. No.: 696,822

[22] Filed: Jan. 31, 1985

[51] Int. Cl.[4] ..... F02P 15/00

[52] U.S. Cl. ..... 123/169 PA; 123/169 PH; 123/635; 123/647; 439/125; 439/723

[58] Field of Search ..... 123/635, 647, 143 R, 123/169 PA, 169 PH; 339/252 S, 26, 89 C

[56] References Cited

U.S. PATENT DOCUMENTS

| | | | |
|---|---|---|---|
| 1,378,260 | 5/1921 | Melton | 123/169 PA |
| 2,399,390 | 4/1946 | Robertson | 123/169 PH |
| 2,686,510 | 8/1954 | Platner | 123/169 PH |
| 3,756,207 | 9/1973 | Davis | 123/90.38 |
| 3,792,694 | 2/1974 | Brenholts | 123/635 |
| 3,859,969 | 1/1975 | Davis | 123/90.61 |

FOREIGN PATENT DOCUMENTS

| | | | |
|---|---|---|---|
| 831949 | 9/1938 | France | 123/169 PA |
| 80419 | 3/1963 | France | 339/26 |
| 556790 | 10/1943 | United Kingdom | 123/169 PH |
| 565853 | 11/1944 | United Kingdom | 123/169 PH |

OTHER PUBLICATIONS

Caterpillar Fundamental English (Form No. REG01497), Sep. 1973, Ignition System, pp. 5–7.

*Primary Examiner*—Andrew M. Dolinar
*Attorney, Agent, or Firm*—Larry G. Cain

[57] ABSTRACT

An ignition system of an engine has a coil which is spaced away from an igniter to protect the coil from heat of a combustion chamber and combustion gas leakage. The electrical connections between the coil and igniter of current design practice have not performed satisfactorily due to loosening of connections, absorbtion of energy within the connectors and the escape of electrical energy. The present ignition extender overcomes these shortcomings by resiliently biasing a first electrical conducting core into contact with a source of high energy and a second electrical conducting core into contact with an igniter and insulating the first and second electrical conducting cores and a biasing and providng mechanism from the surrounding environment by surrounding them with a first and second telescopingly arranged insulating members. When included in an engine, the extender is combined with a shield to further protect and increase the functional life of the components.

21 Claims, 3 Drawing Figures

ENGINE IGNITION SYSTEM WITH AN INSULATED AND EXTENDABLE EXTENDER

TECHNICAL FIELD

This invention relates generally to spark ignited engines and more particularly to ignition systems having ignition extenders located between the source of high energy and the igniter.

BACKGROUND ART

Spark ignited engines of today use three primary types of ignition systems between the high energy source and the igniter. In these three systems, the coil is positioned away from the spark plug. The spacing assures that the coil is away from the heat source which can damage and destroy the working capability of the coil.

The first system uses an external coil and a spark plug connected by a high voltage wire lead. When these wires age and become worn, the high energy being transmitted from the coil to the plug can escape. The escaping energy can be a shock hazard or if the engine is located in a high fuel environment may set off an explosion.

A second system includes an integral coil and an elongated spark plug with a threaded connection between the coil and the spark plug. The threaded connection between the coil and the plug requires a critical alignment therebetween. The location of plug and coil with reference to interference with other engine components such as intake manifolds, exhaust manifolds and valve covers may cause assembly problems. If improperly assembled, the threaded connection can become loose due to engine vibration and allow the high energy being transmitted between the coil and plug to escape causing shock hazards and explosions. Moreover, the elongated spark plugs are constructed with an outer metal case causing the plugs to act as a capacitor. The plugs can absorb between 3000 and 4000 volts rather than conducting this energy to the tip of the igniter.

The third system includes an integral coil with a threaded connection, a spark plug and a threaded extender fixedly attached to the coil and the plug. The alignment problem as discussed earlier also exists and the loosening problem is further enhanced because of an added connection. None of the systems as described above provide for a reliable extension between the coil and spark plug.

The present invention is directed to overcoming one or more of the problems as set forth above.

DISCLOSURE OF THE INVENTION

In one aspect of the invention an ignition extender is adapted for use in an engine to connect between an igniter and a source of high energy. The extender comprises a first electrically conducting core contacting one of the igniter and the source of high energy, a second electrically conducting core contacting the other of the igniter and the source of high energy, means for axially biasing apart the first and second electrically conducting cores and for providing a connection between the first and second electrically conducting cores so that electrical energy passes therethrough, and means for insulating the first electrically conducting core, the second electrically conducting core and the biasing and providing means so that substantially all of the electrical energy passing therethrough is transmitted from the source of high energy to the igniter.

In another aspect of the present invention an insulated ignition system is provided for use in an engine having a combustion chamber and a cover attached to the engine and having a portion spaced therefrom. The ignition system comprises an igniter extending into the combustion chamber, a source of high energy connected to the portion of the cover, a shield extending between and sealably connected to the cover and the engine and having an axially extending passage between the source of high energy and the igniter, and an insulated, resiliently biased extendable ignition extender disposed in electrical conducting contact with the source of high energy and the igniter and positioned within the passage of the shield.

The present invention provides an extender which is insulated and resiliently biased extendably between the igniter and the source of high energy. Futhermore, the biased first and second electrically conducting cores and the telescoping first and second outer tubular insulating members provide a positive electrical contact between the igniter and the source of high energy while guarding against shock hazards and explosions.

BEST MODE FOR CARRYING OUT THE INVENTION

Figure 1:
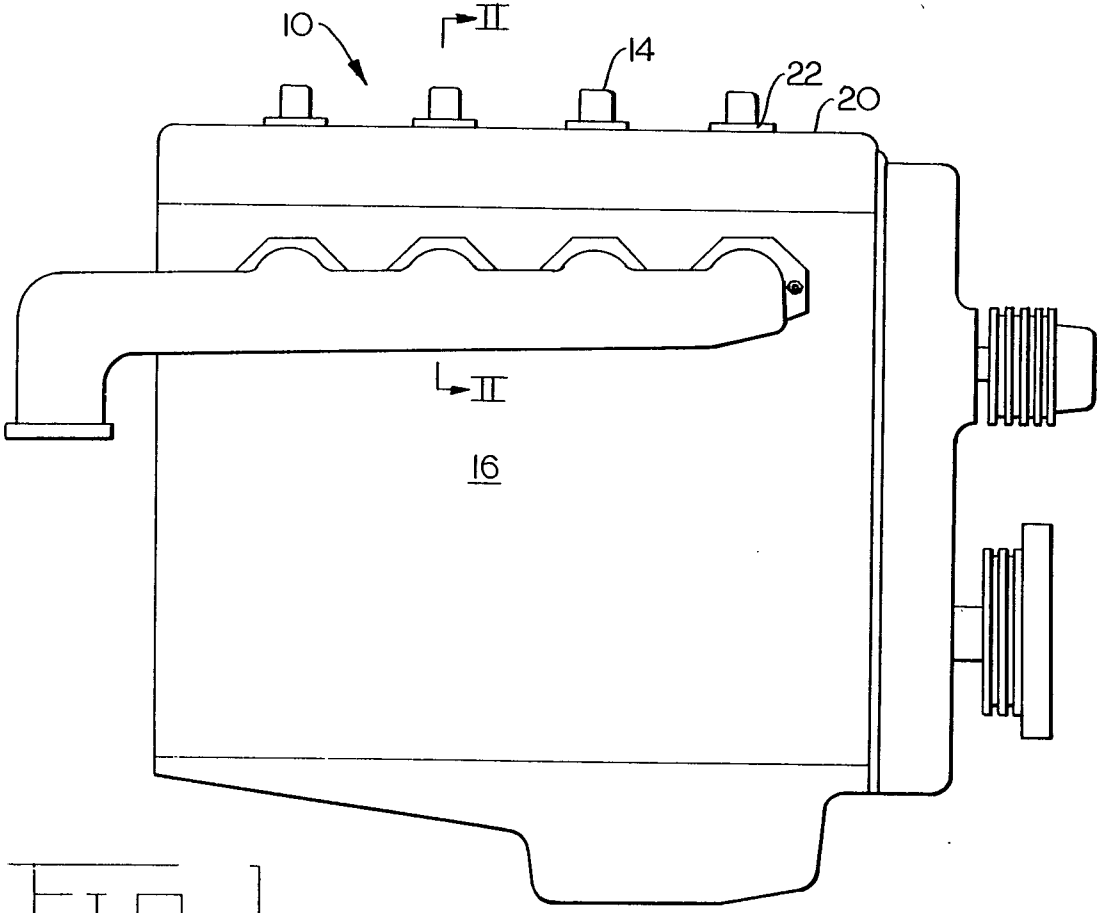
FIG. 1 is a profile view of an engine illustrating an ignition system using the extender.
Figure 2:
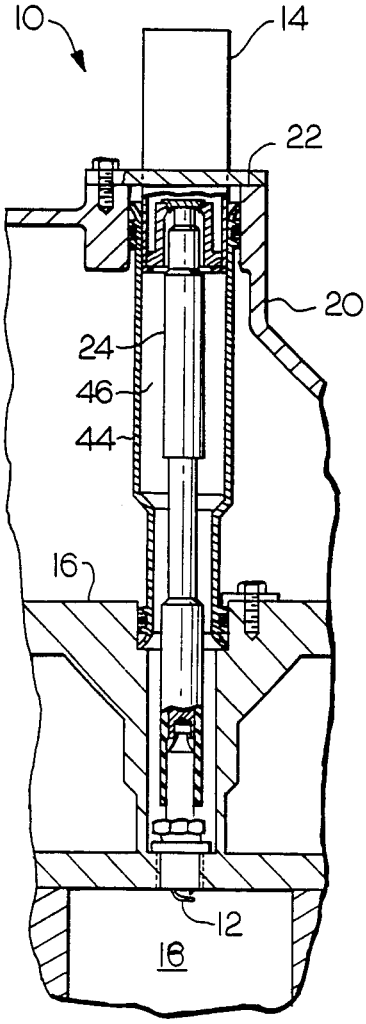
FIG. 2 is a partial section taken along the line II—II of FIG. 1.

Referring now to the drawing, an ignition system 10 having an igniter 12, in this case a spark plug, and a source of high energy 14 or a conventional ignition coil is shown used with an engine 16 in FIG. 1. The engine 16 as shown in FIGS. 1 and 2 is of a conventional spark ignited configuration and includes a combustion chamber 18 wherein the igniter 12 extends into the combustion chamber 18, a cover 20 attached to the engine 16 and a portion 22 of the cover 20 spaced from the igniter 12 and a source of high energy 14.

Figure 3:
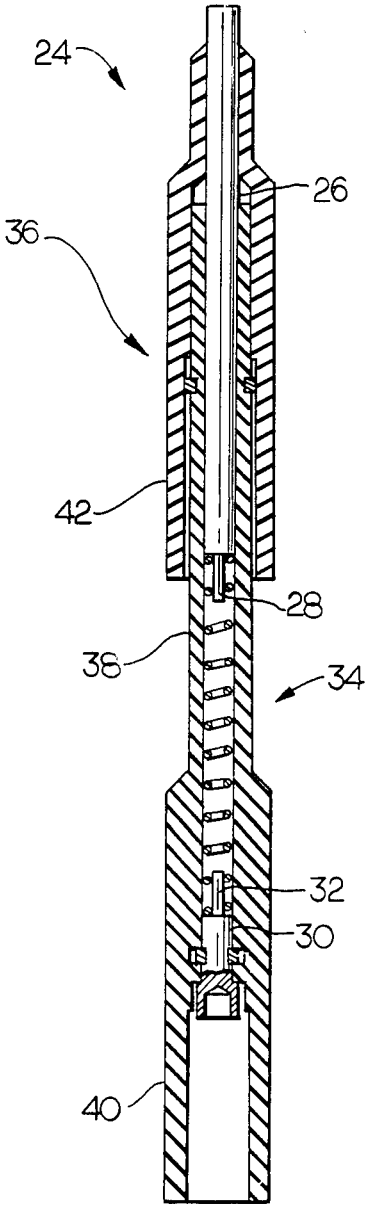
FIG. 3 is an enlarged section view taken through the axial centerline of the extender.

The ignition system 10 includes an insulated ignition extender 24 which is best shown in FIG. 3. The extender 24 is connected between the spark plug 12 and the coil 14. The extender 24 comprises a first electrically conducting core 26 which contacts the coil 14 at one end and has a protrusion 28 at the other end. A second electrically conducting core 30 contacts the spark plug 12 at one end and has a protrusion 32 at the other end. The extender 24 further comprises means 34 for axially biasing apart the first and second cores 26,30 and for providing an electrical connection between the first and second cores 26,30. In this embodiment the biasing means 34 is a compression spring made of electrical conducting material and fitted around the protrusions 28,32 of the first and second cores 26,30. A means 36 for insulating the first core 26, the second core 30 and the means 34 for biasing and providing is also comprised in the extender 24. The first and second electrically conducting cores 26,30 can be made of aluminum, copper or other electrical conductors.

The insulating means 36 includes a first outer tubular insulating member 38 fixedly attached to and surrounding at least a portion of the second core 30, surrounding the biasing and providing means 34 and slidably surrounding the first core 26. The insulating member has a small portion 40 which protrudes beyond the second core 30 and surrounds the igniter 12. The insulating means 36 further includes a second outer tubular insulating member 42 connected to and surrounding at least a portion of first core 26. The first member 38 telescopingly slidingly extends into the second member 42. The preferred material for the first and second outer tubular insulating members 38,42 is a polytetrafluorethene material but could be any other material having similar insulating qualities.

Further included with the extender 24 when used with the engine 16 is a shield 44 extending between and sealably connected to the cover 20 and the engine 16. The shield 44 is made of a metallic material which is in frictional contact with the cover 20 and the engine 16. A passage 46 is provided substantially axially concentric with the spark plug 12 and the coil 14 within the shield 44.

As an alternative the extender could be used with a diesel or turbine engine using a glow plug or another type of igniter.

INDUSTRIAL APPLICABILITY

During operation of the spark ignited engine 16, a flow of electrical energy passes from the coil 14 to the first electrically conducting core 26 through the compression spring 34 and the second electrically conducting core 30 and in turn to the spark plug 12. The spark plug 12 produces a spark and ignites the combustable mixture in the combustion chamber 18. The compression spring 34 exerts an axial force between the first core 26 and the second core 30 providing positive electrical contact between the coil 14 and the first core 26 and between the spark plug 12 and the second core 30. The protrusions 28,32 of the first core 26 and second core 30 guide and center the spring 34. The insulating members 38,42 insure that substantially all of the electrical energy passes through the cores 26,30 and the spring 34. The small portion 40 of the first member 38 protruding beyond the second core 30 prevents loss of energy and arcing between the electrical contact and the environment. The telescoping arrangement of the first and second insulating members insures that the cores 26,30 and spring 34 are insulated to prevent the escape of electrical energy regardless of the length of extension of the cores 26,30 and the spring 34.

The shield 44 is assembled between the cover 20 and the engine 16 to isolate the coil 14, extender 24 and the spark plug 12 from the environment. The shield 44 is in frictional contact with the cover 20 and the engine 16 so that possible explosions within passage 46 are confined therein.

The ignition extender 24 set forth above provides an arrangement insuring that substantially all of the energy is transmitted from the coil 14 to the spark plug 12. The biasing and providing means 34 insures that positive electrical contact is made between the cores 26,30 and the coil 14 and spark plug 12 respectively. The insulating means 36 being telescoping provide an insulating environment around the cores 26,30 and the spring 34 regardless of the length of the extension and the shield 44 seals and protect the extender 24 from deteriation by foreign materials such as oil and acids within the cover 20.

Other aspects, objects and advantages of this invention can be obtained from a study of the drawings, the disclosure and the appended claims.

We claim:

1. An insulated ignition extender adapted for use in an engine to connect between an igniter and a source of high energy, comprising:

a first electrically conducting core adapted to contact one of the igniter and the source of high energy;

a second electrically conducting core adapted to contact the other of the igniter and the source of high energy;

one of said cores being axially movable with respect to the other core to provide a variable length extender;

means for axially biasing apart the first and second electrically conducting cores and for providing a connection between the first and second electrically conducting cores so that electrical energy passes therethrough; and a first outer tubular insulating member fixedly attached to and surrounding at least a portion of one of the first and second electrically conducting cores surrounding the biasing and providing means and slidably surrounding at least a portion of the other of the first and second electrically conducting cores.

2. An insulated ignition extender adapted for use in an engine to connect between an igniter and a source of high energy, comprising:

a first electrically conducting core adapted to contact one of the igniter and the source of high energy;

a second electrically conducting core adapted to contact the other of the igniter and the source of high energy;

one of said cores being axially movable with respect to the other core to provide a variable length extender;

means for axially biasing apart the first and second electrically conducting cores and for providing a connection between the first and second electrically conducting cores so that electrical energy passes therethrough; and means for insulating the first electrically conducting core, the second electrically conducting core and the biasing and providing means so that substantially all of the electrical energy passing therethrough is transmitted from the source of high enery to the igniter, including a first outer tubular insulating member fixedly attached to and surrounding at least a portion of one of the first and second electrically conducting cores, surrounding the biasing and providing means and slidably surrounding at least a portion of the other of the first and second electrically conducting cores.

3. The ignition extender of claim 2 wherein the insulating means further includes a second outer tubular insulating member connected to and surrounding at least a portion of the other of the first and second electrically conducting cores, said first insulating member including a portion 40 extending beyond said one electrically conducting core.

4. The ignition extender of claim 3 wherein said first outer tubular insulating member telescopingly extends into said second outer tubular insulating member.

5. The ignition extender of claim 2 wherein the biasing means is a compression spring.

6. The ignition extender of claim 5 wherein the compression spring is in electrically conducting abutment with the first and second electrically conducting cores.

7. The ignition extender of claim 3 wherein said first and second outer tubular insulating members are made of a polytetrafluorethlene material.

8. The ignition extender of claim 2 wherein the first and second electrically conducting cores are aluminum.

9. The ignition extender of claim 2 wherein the providing means is a compression spring.

10. An ignition system for use in an engine having a combustion chamber and a cover attached to the engine and having a portion spaced therefrom, comprising:

an igniter extending into the combustion chamber;

a source of high energy connected to the portion of the cover;

a shield extending between and sealably connected to the cover and the engine, said shield having an axially extending passage therein; and an insulated, resiliently biased extendable ignition extender disposed in electrical conducting contact between the source of high energy and the igniter and positioned within the passage of the shield, said extender including a first electrically conducting core adapted to contact one of the igniter and the source of high energy, a second electrically conducting core adapted to contact the other of the igniter and the source of high energy, means for axially biasing apart the first and second electrically conducting cores and means for insulating the first electrically conducting core, the second electrically conducting core and the biasing and providing means so that substantially all of the electrical energy passing therethrough is transmitted from the source of high energy to the igniter and said insulating means including a first outer tubular insulating member fixedly attached and surrounding at least a portion of one of the first and second electrically conducting cores, surrounding the biasing and providing means and slidably surrounding at least a portion of the other of the first and second electrically conducting cores.

11. The ignition system of claim 10 wherein the insulating means further includes a second outer tubular insulating member connected to and surrounding at least a portion of the other of the first and second electrically conducting cores, said first outer tubular insulating member including a portion extending beyond said one electrically conducting core.

12. The ignition system of claim 10 wherein said first outer tubular insulating member telescopingly extends into said second outer tubular insulating member.

13. The ignition system of claim 10 wherein the first and second electrically conducting cores are aluminum.

14. The ignition extender of claim 10 wherein the biasing means is a compression spring.

15. The ignition system of claim 11 wherein said first and second outer tubular insulating members are made of a polytetrafluorethlene material.

16. The ignition system of claim 10 wherein the source of high energy is a standard ignition coil.

17. The ignition system of claim 10 wherein the igniter is a spark plug.

18. The ignition system of claim 10 wherein the shield is in frictional contact with the cover and the engine.

19. The ignition system of claim 10 wherein the shield is a metallic material.

20. The ignition extender of claim 10 wherein the providing means is a compression spring.

21. An insulated ignition extender adapted for use in an engine to connect between an igniter and a source of high energy, comprising:

a first electrically conducting core adapted to contact one of the igniter and the source of high energy and having a first outer tubular insulating member fixedly attached thereto;

a second electrically conducting core adapted to contact the other of the igniter and the source of high energy and having a second outer tubular insulating member fixedly attached thereto;

one of said outer tubular insulating members being axially movable with respect to the other member to provide a variable length extender;

means for axially biasing apart the first and second electrically conducting cores and for providing a connection between the first and second electrically conducting cores so that electrical energy passes therethrough; and one of said first and second outer tubular insulating member being telescopingly slidingly extending into the other one of the first and second outer tubular insulating member so that substantially all of the electrical energy passing therethrough is transmitted from the source of high energy to the igniter.

* * * * *